United States Patent [19]

Sachs et al.

[11] Patent Number: 4,675,234

[45] Date of Patent: Jun. 23, 1987

[54] RADIATION CURED COATING AND PROCESS THEREFOR

[75] Inventors: Peter R. Sachs, New Windsor; James W. Sears, Newburgh, both of N.Y.

[73] Assignee: Tarkett AB, Ronneby, Sweden

[21] Appl. No.: 735,180

[22] Filed: May 17, 1985

Related U.S. Application Data

[63] Continuation-in-part of Ser. No. 593,315, Mar. 26, 1984, abandoned, which is a continuation of Ser. No. 369,752, Apr. 19, 1982, Pat. No. 4,439,480, which is a continuation of Ser. No. 192,587, Oct. 1, 1980, Pat. No. 4,326,001.

[51] Int. Cl.[4] ..... B05D 3/06

[52] U.S. Cl. ..... 428/328; 427/44; 427/54.1

[58] Field of Search ..... 427/44, 54.1, 203, 205; 428/328

[56] References Cited

U.S. PATENT DOCUMENTS

| | | | |
|---|---|---|---|
| 3,234,038 | 2/1966 | Stephens et al. | 428/328 |
| 3,293,094 | 12/1966 | Nairn et al. | 428/158 |
| 3,713,864 | 1/1973 | Ackerman et al. | 427/44 |
| 3,918,393 | 11/1975 | Hahn | 427/44 |
| 4,070,497 | 1/1978 | Wismer et al. | 427/44 |
| 4,097,639 | 6/1978 | Millar | 427/27 |
| 4,105,806 | 8/1978 | Watt | 427/44 |
| 4,113,895 | 9/1978 | Watt et al. | 427/54.1 |
| 4,122,225 | 10/1978 | Holmstrom et al. | 427/54.1 |
| 4,180,615 | 12/1979 | Bettoli | 428/523 |
| 4,504,523 | 3/1985 | Miller et al. | 427/44 |

*Primary Examiner*—John H. Newsome

*Attorney, Agent, or Firm*—Nies, Webner, Kurz & Bergert

[57] ABSTRACT

An article having a radiation cured coating is formed by:

(a) applying to a substrate a first layer of pigmented or unpigmented radiation curable material containing glitter particles such as metallic particles or synthetic glitter particles;

(b) applying a second layer of unpigmented radiation curable material over the first layer, and (c) curing the first and second layers with ionizing irradiation or ultraviolet light, either in two steps or in a single curing step after both layers have been applied.

7 Claims, No Drawings

RADIATION CURED COATING AND PROCESS THEREFOR

CROSS REFERENCE TO RELATED APPLICATIONS

This application is a continuation-in-part of application Ser. No. 593,315 filed March 26, 1984, now abandoned which is a continuation of application Ser. No. 369,752, filed Apr. 19, 1982, now U.S. Pat. No. 4,439,480, which is a continuation of application Ser. No. 192,587, filed Oct. 1, 1980, now U.S. Pat. No. 4,326,001.

BACKGROUND OF THE INVENTION

Radiation curable coatings for use on a variety of substrates and curable by exposure to ionizing irradiation or ultraviolet light are well known. The use of urethane type coatings cured with ultraviolet light to provide protective wear layers for wall or floor tile is for instance described in U.S. Pat. No. 4,180,615. U.S. Pat. No. 3,918,393 describes a method for obtaining a non-glossy coating on various substrates by curing radiation sensitive material with ionizing irradiation or ultraviolet liqht in two stages. In this process the coating is partially cured in an oxygen-containing atmosphere and the curing is completed in an inert atmosphere. U.S. Pat. No. 4,122,225 discloses a method and apparatus for coating tile which involves the application of one coat of radiation curable material to an entire substrate followed by partial curing and the subsequent application and curing of a second coat of radiation curable material only on high areas of the substrate which are subject to greater than average wear.

Use of pigment in radiation cured coatings on products such as floor covering which are subject to wear during use has presented substantial difficulties. Incorporation of pigment, especially enough pigment to make the coating opaque, makes the coating hard to cure and substantially reduces the thicknesses of coating which can be cured relative to a clear coating cured under the same conditions.

The specifications of U.S. Pat. No. 4,326,001 and U.S. Pat. No. 4,439,480 are incorporated herein by reference.

SUMMARY OF THE INVENTION

The product of the invention is a coated article comprising a substrate with two layers of radiation cured coating material adhered thereto. The first layer, which may be pigmented or unpigmented, contains glitter particles which may be metallic particles or flakes of synthetic material such as mylar, and is preferably between 0.01 and about 0.1 millimeter (mm) thick. The second layer is preferably between about 0.01 and about 0.15 mm thick, of the same or a different radiation cured coating material. In a preferred embodiment the coating layers comprise urethane compound photo-polymerized from a fluid coating composition comprising at least two photo-polymerizable ethylenically unsaturated groups of the general structure

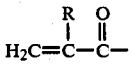

where R is either H or $CH_3$.

The process of the invention is a method of forming a radiation cured coating on a substrate comprising:

(a) applying to the substrate a first layer between about 0.01 and about 0.1 mm thick of radiation curable material containing glitter particles, and (b) applying to the surface of the first layer a second layer between about 0.01 and about 0.15 mm thick, of the same or a different radiation curable material, and (c) curing the coating. The curing may be conducted in one stage after both coating layers are applied to the substrate, or may be conducted in two stages as disclosed in U.S. Pat. No. 4,326,001 and U.S. Pat. No. 4,439,480.

DETAILED DESCRIPTION OF THE INVENTION

The invention contemplates the formation of pigmented radiation cured coatings on a wide variety of substrates including such diverse materials as wood, glass, plastics, metals, paper, etc. The invention has particular applicability to tiles and decorative sheet covering material suitable for use on walls and floors, especially vinyl tiles and sheet vinyl.

The process may either take place "on-line" by coating and curing a sheet of conventional tile base which optionally may have been embossed and/or printed, and then cutting the sheet into tiles, or the process may be "off-line", the optionally embossed and/or printed tile base being precut into tiles and then coated and cured.

Radiation curable coatings suitable for use in the invention may in general be selected from any of the coating materials known to be suitable for curing with ionizing irradiation or ultraviolet light. In this respect, ultraviolet light is generally considered to be light having wavelengths in the range from about 2500Å to about 4000Å. The term "ionizing irradiation" is generally considered to include high energy radiation and/or secondary energies resulting from conversion of electrons or other particle energy to x-rays or gamma radiation. While various types of ionizing irradiation are suitable, for instance x-rays or gamma rays, the radiation produced by accelerated high energy electrons generally known as electron beam radiation, has been found to be convenient and economical and to give satisfactory results. Ionizing irradiation equivalent to at least about 100,000 electron volts is generally satisfactory. Ultraviolet light is, however, an especially preferred form of radiation for use in the invention.

The first layer of coating, which is preferably between about 0.01 and about 0.1 mm thick, may be pigmented or unpigmented, in addition to containing glitter particles which may be metallic flakes or synthetic glitter flakes, for example, mylar flakes. Use of pigment in radiation cured coatings has, in the past, presented substantial difficulties in curing, and has limited the thickness of pigmented coatings which may be cured with radiation compared with unpigmented coatings cured under the same conditions. The use of metallic or synthetic glitter flakes unexpectedly does not encounter the same problems, and the amount of glitter flakes which may be added is limited by aesthetic and economic factors, and not by curing ability. The second layer, which is a clear wear layer, may be of the same or a different composition from the first layer, but preferably does not contain glitter particles.

The overall thickness of the two layers used is generally between about 0.01 and about 0.25 millimeters. With coatings of such thickness, the total dosage of ionizing irradiation or ultra-violet light is frequently between about 0.2 and about 30 megarads or more. In this respect a rad is defined as that amount of radiation required to supply 100 ergs of energy per qram of material treated, and a "megarad" is $10^6$ rads.

In general, any radiation curable coatings may be used in the invention, including those disclosed in the above mentioned U.S. Pat. No. 3,918,393. Preferred coatings are, however, the urethane coatings described in U.S. Pat. No. 4,180,615 wherein the cured coating is formed from a fluid coating composition comprising at least two photo-polymerizable ethylenically unsaturated groups of the general structure:

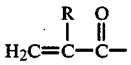

Where R is either H or $CH_3$.

Any conventional coating method may be used to apply coatings for use in the invention. Such conventional methods as roll coating, spraying, dip coating, curtain coating, and the like are, for instance, suitable for both coatings with roll coating being preferred for the first coating.

In one method of practicing the process of the invention, a first layer of radiation curable coating material containing glitter flakes is coated onto the substrate, for example, by roll coating, and partially cured by exposure to ionizing irradiation or preferably ultraviolet light in an oxygen containing atmosphere containing at least 5,000 ppm of oxygen. Air is, for instance, a suitable atmosphere for only a partial cure in the sense that the curing is carried out only to the point where the layer is at least gelled and optionally completely cured throughout a portion of its thickness, but in any event only to the point where at least the surface of the first layer remains partially uncured and at least somewhat tacky. Curing of the surface of the first layer is completed at the same time as curing of the second layer.

Following the application and partial curing of the first layer of radiation curable coating material in an oxygen containing atmosphere, a second layer of the same or a different coating is applied, for example, by roll coating, to the at least partially uncured first layer and the entire coating, i.e., both layers, is then subjected to complete curing in an inert atmosphere containing less than about 1,000 ppm oxygen and frequently less than about 250 ppm oxygen. Gases such as nitrogen, helium, etc. are for instance suitable for providing the inert atmosphere.

In an alternative method of practicing the invention, the curing process takes place in one step only. According to this method, the first layer of glitter containing radiation curable material is coated onto the tile by any suitable method, e.g., roll coating. Then, without curing this layer, the second layer of radiation curable material is coated on top of the first layer in a wet-on-wet process, for example, by curtain coating, and both layers of coating are cured together in an inert atmosphere containing less than about 1,000 ppm oxygen, as described above.

If both layers are applied by roll coating, for example, in an on-line process, then the material must be cured in two steps, i.e., partially cured after the first layer is applied, with the completion of the curing after the second layer is applied. This is necessary because, if roll coating is used for application of the second layer without having at least partially cured the first layer, the second roll coating may contaminate the surface of the first layer. If however, the second layer is applied by curtain coating, or other method of coating which allows a "wet-on-wet" second layer to be applied without contamination of the surface of the first layer, then both layers may be cured in a single curing step by subjecting the coating to ionizing radiation or ultra-violet light in an inert atmosphere containing less than about 1000 ppm of oxygen until both layers of the coating are completely cured.

This alternative method using a "wet-on-wet" coating process may conveniently be carried out by coating pre-cut, optionally printed and embossed, tiles in an "off-line" process in which the production line, which may travel at speeds of 100–120 ft/min for the roll coating step, is speeded up to 400–500 ft/min for the curtain coating, and then slowed again to 100–120 ft/min for the one-stage curing process.

For a better understanding of suitable substrates and radiation curable coatings, as well as techniques for curing such coatings and making the tiles having radiation cured coatings, reference may be had to U.S. Pat. Nos. 3,918,393, 4,122,225, 4,180,615 and 3,293,094 the disclosures of which are incorporated.

Viscosity of radiation curable coatings used in the invention may vary widely depending upon the particular coating technique employed. In a preferred embodiment in which roll coating is used, the viscosity is preferably between about 1,000 and about 5,000 centipoises (cp) at 77° F. Increasing the percentages of glitter particles in the coating materials increases the viscosity.

Various conventional additives for radiation curable coatings may of course be present in coatings of the invention. These include such materials as fillers, dyes, thermoplastic additives, plasticizers, synthetic resins, heat and liqht stabilizers, photo-initiators, fillers such as carbon black, glass fibers, silica, etc.

It has unexpectedly been found that flakes of glitter, such as metal or Mylar, even up to 33.3% by weight of the base coating, may be incorporated into the polyurethane coating material without curing problems, though resin containing above about 20% by weiqht of glitter flakes is harder to coat due to its high viscosity. The flakes appear to reflect the ultraviolet radiation, without substantially absorbing it, so that the radiation is still available to function as a curing agent. Conventional pigments and other additives may also be present in coatings of the invention, as disclosed in U.S. Pat. Nos. 4,439,480 and 4,326,001, so that a floor tile of the invention may have glitter flakes embedded in a pigmented or unpigmented base layer, without encountering curing problems. The second layer is preferably a clear unpigmented wear layer either of the same or a different formulation as that used in the base coat. and preferably between about 0.01 and 0.15 mm thick.

The glitter flakes are preferably present in the first layer only, the second layer of the coating acting as a protective wear layer.

Coating compositions for use in the invention are preferably substantially free of non-reactive solvent, i.e., contain no more than about 5 wt % solvent. Total inactive ingredients, such as the pigments, additives and non-reactive solvent mentioned above, where used, are preferably present in amounts of no more than 10 wt %, excluding the glitter flakes which may be present up to 33.3% wt % of the first layer of coating but preferably up to 15 wt %.

Where the preferred urethane type coating compositions described above are used and cured by ultraviolet radiation, photosenitizers are generally employed in amounts between about 0.5 to about 5% by weight of the composition. Such preferred compositions also preferably include one or more mono or difunctional vinyl monomers, copolymerizable under ultraviolet radiation with the above indicated urethane compounds used in the coating composition. The monomer must also be sufficiently stable to prevent premature gellation or reaction with the urethane compounds prior to exposure to ultraviolet light for curing of the coating. If desired, small amounts of polymerization inhibitors may be added for this purpose. Suitable monofunctional monomers include, for instance, acrylates or methacrylates having the formula:

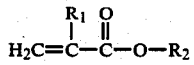

Where $R_1$ is H or $CH_3$ and $R_2$ is an alkyl or cycloalkyl group having 6 to 18 carbon atoms, a phenozylalkyl group of 6 to 18 carbons or hydroxyalkyl group. Suitable monomers are described in greater detail in the above-mentioned U.S. Pat. No. 4,180,615.

The following examples are intended to illustrate the invention without limiting the scope thereof.

EXAMPLE 1

A clear acrylo-urethane (Glidden 879-C-576) coating was tinted with 1% of a matched pigmented dispersion of three individual pigmented dispersions. The matched color concentrate was dark brown.

The tinted coating was fed into a first direct roll coater. An untinted coating of the same composition as the tinted coating was fed into a second direct roll coater.

The substrate used was conventional tile base about 80 mils thick printed and embossed to look like a red brick pattern. This substrate was then coated with the first coating, so that all of the sheet was covered by the tinted coating with enough pressure to leave puddles in the embossed valleys but wiped off the tops. The substrate temperature at the first roll coater was about 160°-170° F.

The coated sheet was then passed under a first source of UV radiation in a air atmosphere which cured the lower layers of the tinted coating and partially cured the exposed surface of the tinted coating, leaving it tacky so that when the sheet was now passed through the second direct roll coater (which applied about 2 mils of untinted coating) this coating adhered to it. The sheet was next passed under a second source of UV radiation, but in a nitrogen inerted atmosphere, where both coatings applied were completely cured.

The coated sheet was cut into tiles.

EXAMPLE 2

4% (by weight) of a "glitter" product from Atlantic Powdered Metal, Inc. (Non-Tarnish Sparkles-Mylar 0.004 inches×0.0005 inches) was blended into a clear acrylic-urethane coating (Glidden 879-C-602).

This coating was fed into a direct roll coater.

The substrate used was a conventional tile base about 80 mils thick, printed and embossed, and cut into tiles. The tiles were coated with the "glitter" containing coating, so that the tile was coated in all areas including the embossed valleys. The substrate temperature at the roll coater was about 150° F.

The coated tile was then passed through a curtain coater where about 4 mils of the same coating, without the "glitter", was applied. The sheet was next passed under a source of UV radiation in a nitrogen inerted atmosphere, where both coatings applied were completely cured.

The finished tile showed mylar glitter particles randomly scattered over the printed tile base.

EXAMPLE 3

The method of Example 2 was repeated, but in addition to the 4% "glitter", an organic pigment concentrate (yellow 12341 from Penn Color Corp) was also added in a 1% (by weight) quantity. The processing of the tile was exactly like that in example 2. The finished tile was yellow with glitter particles scattered through the coating.

EXAMPLE 4

The method of Example 2 was repeated, but using 16.7% "glitter". The finished tile was similar to that produced by Example 2, but had a more pronounced glitter effect on its surface.

While the invention has been described above with respect to certain embodiments thereof, it will be appreciated that various changes and modifications may be made without departing from the spirit and scope of the invention.

What is claimed is:

1. Method of forming a radiation cured coating on a substrate comprising:

(a) applying by roll coating to the substrate a first layer between about 0.01 and about 0.1 mm thick of radiation curable material containing glitter particles in an amount of from about 4 to 33.3% by weight of said first layer;

(b) applying by curtain coating to the surface of the first layer an unpigmented second layer between about 0.01 and about 0.15 mm thick of the same or a different radiation curable material in a wet-on-wet process; and (c) subjecting the first and second layers to ionizing irradiation or ultraviolet light in an inert atmosphere containing less than about 1,000 ppm oxygen in a one stage curing process after both layers have been applied to the substrate, to thereby cure the coating.

2. Method according to claim 1 wherein the radiation curable material of said first and second layers is substantially solvent free.

3. Method according to claim 1 wherein the coating material used for said layers of material comprises in each case fluid urethane compound containing at least two photo-polymerizable, ethylenically unsaturated groups of the general structure:

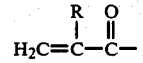

where R is either H or $CH_3$.

4. Method according to claim 1 wherein the substrate is vinyl tile base material or sheet vinyl material.

5. A coated article formed by the method of claim 1.

6. The method of claim 1 wherein said first layer contains, in addition to said glitter particles, from about 1 to 10% by weight of pigment.

7. The method of claim 1 wherein said glitter particles are metallic flakes or synthetic glitter flakes.

* * * * *